US007575132B2

(12) United States Patent
Stuart et al.

(10) Patent No.: US 7,575,132 B2
(45) Date of Patent: Aug. 18, 2009

(54) FLUID DISPENSER HEAD

(75) Inventors: Bruno Stuart, Orival (FR); Patrick Muller, Bailleul (FR)

(73) Assignee: Valois S.A.S., Le Neubourg (FR)

( * ) Notice: Subject to any disclaimer, the term of this patent is extended or adjusted under 35 U.S.C. 154(b) by 703 days.

(21) Appl. No.: 11/129,436

(22) Filed: May 16, 2005

(65) Prior Publication Data

US 2006/0076363 A1 Apr. 13, 2006

(30) Foreign Application Priority Data

May 14, 2004 (FR) ..... 04 05285

(51) Int. Cl.
*B65D 88/54* (2006.01)

(52) U.S. Cl. ..... 222/383.1

(58) Field of Classification Search ..... 222/183, 222/321.8–321.9, 383.1, 402.1
See application file for complete search history.

(56) References Cited

U.S. PATENT DOCUMENTS 3,640,274 A * 2/1972 Costello ..... 128/200.14
3,653,556 A * 4/1972 Moran et al. ..... 222/309
5,310,089 A * 5/1994 Hudgins ..... 222/79
5,819,986 A * 10/1998 Last et al. ..... 222/95
6,089,410 A * 7/2000 Ponton ..... 222/183
6,253,971 B1 * 7/2001 Cobb ..... 222/402.1
2002/0108970 A1 * 8/2002 Shanklin et al. ..... 222/321.9
2006/0157511 A1 * 7/2006 Do Rosario et al. ..... 222/183
2007/0257067 A1 * 11/2007 Parmentier et al. ..... 222/507
2008/0023498 A1 * 1/2008 Bertin et al. ..... 222/402.12
2008/0116232 A1 * 5/2008 Michaux et al. ..... 222/507

FOREIGN PATENT DOCUMENTS

FR 2 846 639 A 5/2004

* cited by examiner

*Primary Examiner*—Kevin P Shaver
*Assistant Examiner*—Andrew P Bainbridge
(74) *Attorney, Agent, or Firm*—Sughrue Mion, PLLC

(57) ABSTRACT

A fluid dispenser head for mounting on a fluid reservoir (1), said head comprising: a dispenser member (2), such as a pump, for taking fluid from the reservoir (1), said member (2) including a body (20) and an actuator rod (24) that is displaceable along an actuation axis; an axially-displaceable pushbutton (7) for actuating the dispenser member (2) by pressing on the actuator rod (24); a covering jacket (6) for mounting securely relative to the reservoir (1), the pushbutton (7) being axially movable relative to the jacket (6), said jacket (6) having a stationary reception housing (600) formed therein; and a nozzle (55) through which the fluid is dispensed each time the dispenser member (1) is actuated, the nozzle (55) being received in said stationary reception housing (600) of the jacket (6), so that the nozzle (55) is held axially relative to the reservoir (1), the fluid dispenser head being characterized in that the nozzle (55) is received in said housing (600) from inside the jacket (6).

15 Claims, 6 Drawing Sheets

FLUID DISPENSER HEAD

The present invention relates to a dispenser head for mounting on a fluid reservoir. In this context, the dispenser head comprises a dispenser member, a pushbutton, a covering jacket, and a nozzle. The term "nozzle" should be understood as meaning any part (or element of a part) through which fluid is expelled from the dispenser head in a wide variety of forms, such as a spray, a continuous stream, a bead, etc.

The fields of cosmetics and of perfumery are preferred fields of application for such dispenser heads. An application in the field of pharmacy can also be envisaged.

Prior-art dispenser heads generally comprise a dispenser member, such as a pump or a valve, mounted on a fluid reservoir by means of a fastener ring. A jacket covering the fastener ring is optionally provided for reasons of appearance. The dispenser member generally includes a pump body in which a piston can slide up and down. More particularly, the piston slides in a pump chamber that is generally provided with an inlet valve and with an outlet valve. The pump body has both a bottom end that is normally provided with a dip-tube that is suitable for taking the fluid contained in the reservoir, and a top end in which an axially-displaceable actuator rod is inserted. The actuator rod, which is generally secured to a piston, defines an inside channel through which fluid can pass. A pushbutton that can be actuated by the user is generally put in place on the top of the actuator rod. Pressure exerted by means of one or more of the user's fingers thus causes the actuator rod to descend, thereby reducing the volume of the pump chamber, and therefore increasing the pressure inside said chamber. The increase in pressure thus causes the fluid contained in said chamber to be expelled. The pushbutton generally includes a dispenser duct in communication with the inside channel of the actuator rod. The dispenser duct opens out to a dispenser orifice enabling the fluid to be expelled. It should be noted that a distinct portion of the pushbutton can serve to actuate the dispenser member, the pushbutton then serving only to cause the fluid to flow.

In addition, it should be observed that the dispenser orifice can either be movable or stationary. In other words, the dispenser orifice can move axially together with the pushbutton, or it can remain stationary in its place, i.e. being independent of the actuator stroke of the pushbutton.

A nozzle can generally be disposed at the outlet of the dispenser channel. Various types of nozzle are to be found in the prior art.

The nozzle can be placed at the outlet from the dispenser duct of a pushbutton that moves together with the actuator rod. The pushbutton can then be covered by a covering jacket provided with an opening for passing the fluid expelled from the dispenser orifice of the nozzle. Naturally, pressing the actuator rod thus causes the dispenser duct and the nozzle to move axially simultaneously. An oblong-shaped opening is then generally provided in the jacket, so as to enable the nozzle to move axially in the opening, following the up-and-down movements of the rod and the duct. Consequently, the opening formed in the jacket to allow for axial displacement of the nozzle is very often too large, and therefore looks ugly.

In another example, the nozzle can be a fitting that is disposed on a nozzle-carrier engaged via the outside in a specific housing in the covering jacket. The nozzle-carrier then has a free front surface provided with a dispenser orifice, and includes a fastener bushing with connection profiles. The connection profiles project outwards and are thus capable of becoming positioned in a fastening location formed in the walls of the dispenser duct. Consequently, the free front surface is a visible surface of the dispenser head which extends all around the orifice. As a result of the external connection profiles, the nozzle presents a diameter that is greater at the profiles than at the free front surface. As a result, the special housing in the jacket needs to be overdimensioned in order to be capable of passing the profiles of the nozzle. Finally, the front surface of the nozzle floats in the housing of the jacket. Therefore, the free front surface tends to be noticed easily by the user and very often does not present an attractive appearance.

An object of the present invention is to define a dispenser head that overcomes the above-mentioned drawbacks of the prior art.

More particularly, an object of the present invention is to define a dispenser head including a nozzle that is simple to mount, while preserving the overall attractive appearance of the dispenser head.

Another object of the present invention is to define a dispenser head with a stationary spray and at a cost that is advantageous.

To achieve these objects, the present invention proposes a fluid dispenser head for mounting on a fluid reservoir, said head comprising: a dispenser member, such as a pump, for taking fluid from the reservoir, said member including a body and an actuator rod that is displaceable along an actuation axis; an axially-displaceable pushbutton for actuating the dispenser member by pressing on the actuator rod; a covering jacket for mounting securely relative to the reservoir, the pushbutton being axially movable relative to the jacket, said jacket having a stationary reception housing formed therein; and a nozzle through which the fluid is dispensed each time the dispenser member is actuated, the nozzle being received in said stationary reception housing of the jacket, so that the nozzle is held axially relative to the reservoir, the fluid dispenser head being characterized in that the nozzle is received in said housing from inside the jacket. The fact that the nozzle is received from the inside of the dispenser head, and in particular from the inside of the jacket, has an undeniably pleasing appearance. The positioning of the nozzle does not require complex fitting. Furthermore, only the orifice of the nozzle is visible to the user.

The nozzle is advantageously displaceable between an initial pre-assembly position in which the nozzle is positioned inside the jacket, facing the housing, without being engaged in said housing, and a final assembled position in which the nozzle is engaged in said housing.

The nozzle is advantageously received in the housing substantially without clearance. The nozzle to be assembled in the stationary reception housing of the jacket can present substantially the same dimensions and the same shape as the opening defined by the housing.

The housing advantageously presents dimensions that are equal to, or slightly greater than, the dimensions of the nozzle.

The nozzle is advantageously secured to a nozzle-carrier.

The nozzle-carrier is advantageously guided to move in translation and blocked against axial displacement on an insert that is securely mounted relative to the jacket. The guiding and blocking therefore prevent any possibility of the nozzle being poorly positioned relative to the housing in which it is received.

The nozzle-carrier advantageously includes a shoe, and the insert includes a slide cage, and the shoe is received in the cage in such a manner as to be displaceable in translation.

Advantageously, the dispenser head further comprises an endpiece mounted on the actuator rod so that the endpiece is axially displaceable with the rod, the nozzle-carrier being connected to the endpiece by a flexible connection hose.

Advantageously, the dispenser head further comprises: an endpiece mounted on the actuator rod so that the endpiece is axially displaceable with the rod, said endpiece including an upstream connection sleeve defining an upstream axis; the nozzle defining a dispenser axis, the nozzle being secured to a downstream connection sleeve defining a downstream axis; and a flexible connection hose connecting the upstream sleeve to the downstream sleeve, the downstream axis being perpendicular, or at least transversal, to the dispenser axis.

The upstream axis is advantageously perpendicular, or at least transversal, to the actuation axis The flexible hose advantageously extends with a U-shaped or horseshoe-shaped configuration. This shape therefore requires the hose to be flexible and thus means that the hose must be sufficiently deformable to enable the actuator rod to descend without causing the nozzle inserted in the stationary reception housing of the jacket to be displaced.

The downstream sleeve is advantageously formed by the nozzle-carrier.

According to an advantageous characteristic of the invention, the housing and the nozzle present identical shapes that are advantageously circular.

The jacket advantageously presents an outside surface and an inside surface, the housing connecting the inside surface to the outside surface, the nozzle including a front surface that is provided with a dispenser orifice, said front surface being situated substantially in the same plane as the outside surface of the jacket.

The invention is described more fully below with reference to the accompanying drawings which show an embodiment of the invention by way of non-limiting example.

Figure 5A:
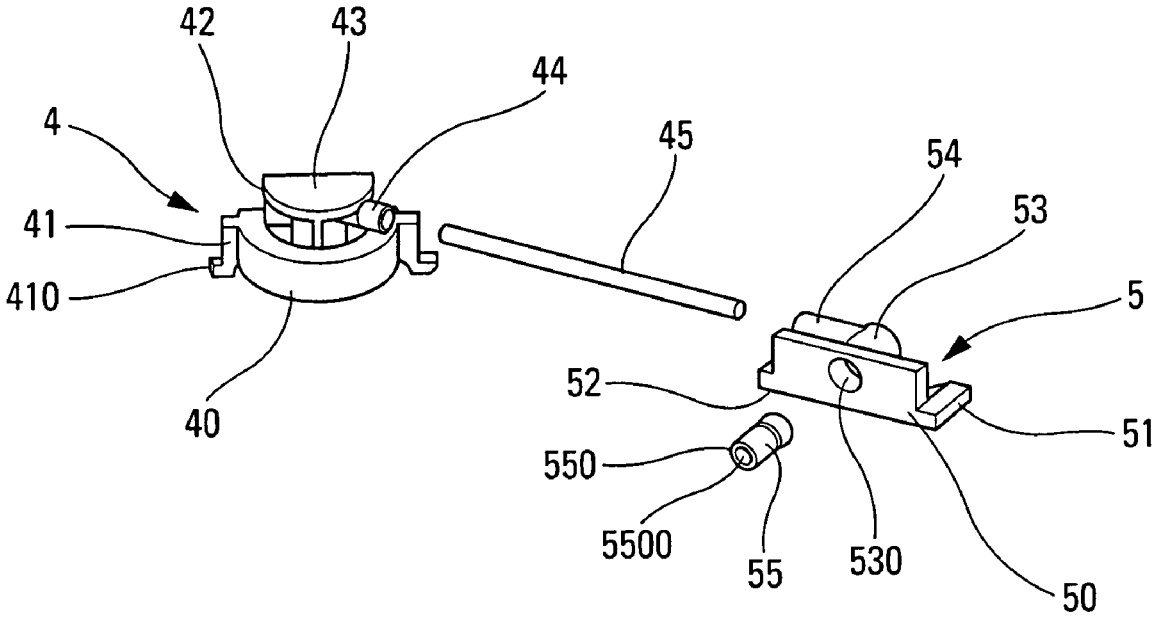
Figure 5B:
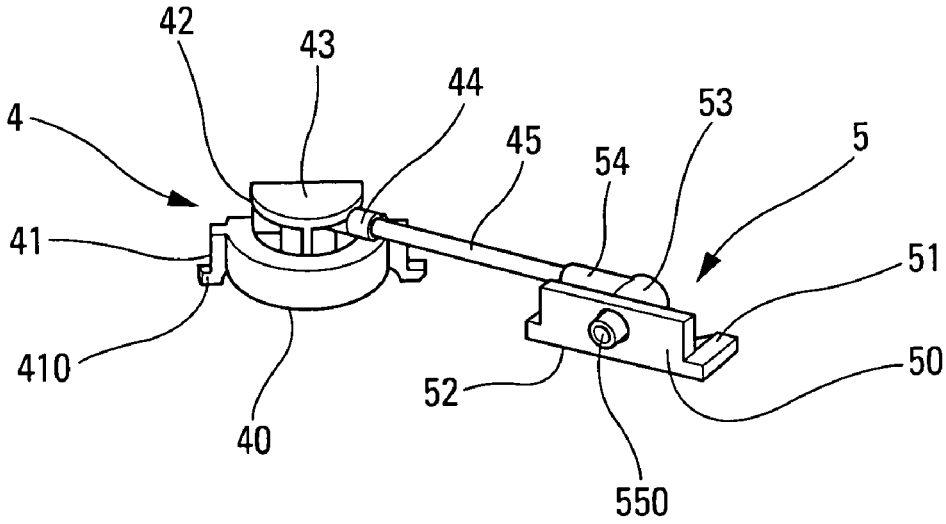
Figure 6:
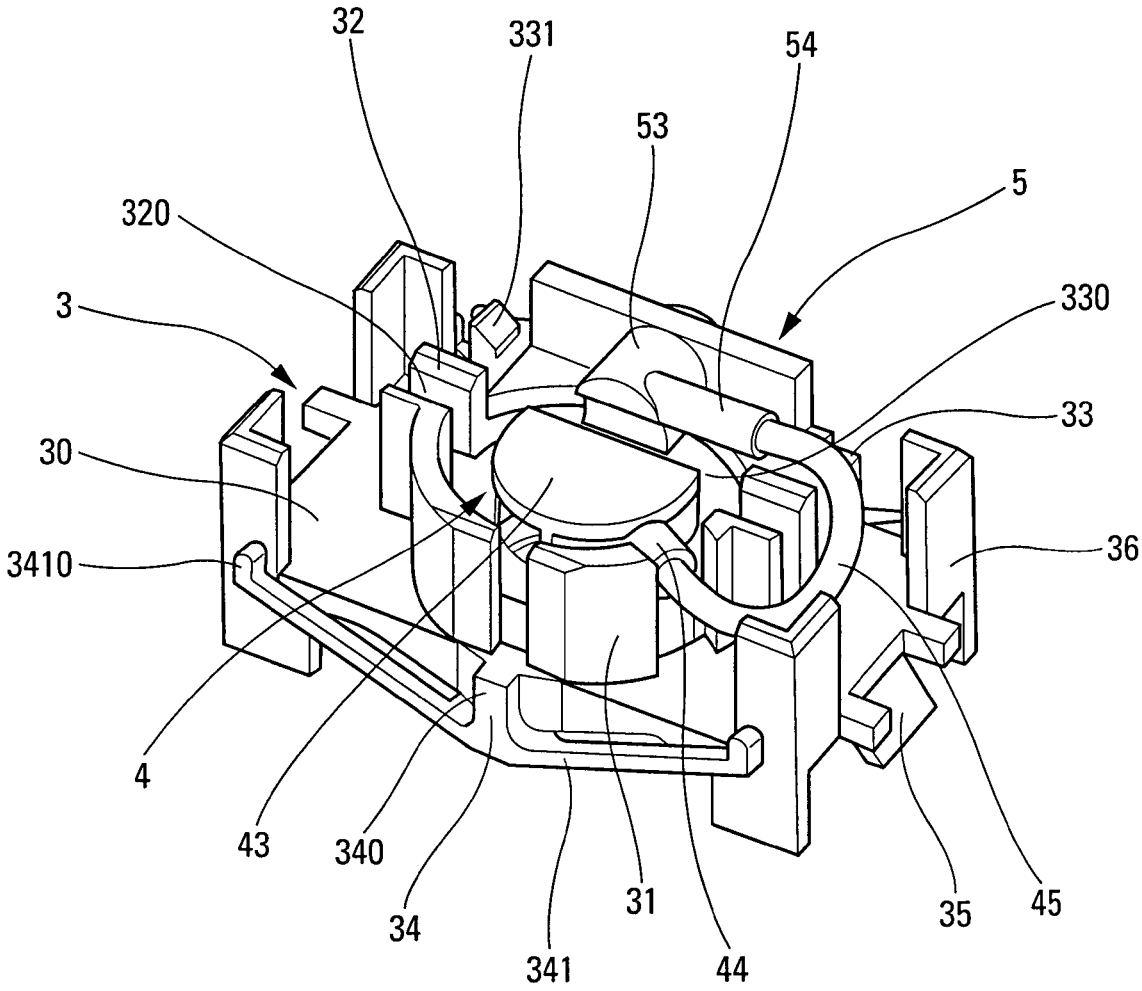

FIG. 5*a* is an exploded perspective view showing elements belonging to the dispenser head in their dismantled state;

FIG. 5*b* is a perspective view showing the FIG. 5*a* elements in their assembled-together state; and FIG. 6 is a perspective view of the elements of FIGS. 5*a* and 5*b* mounted on another element of the dispenser head of the invention.

Figure 1:
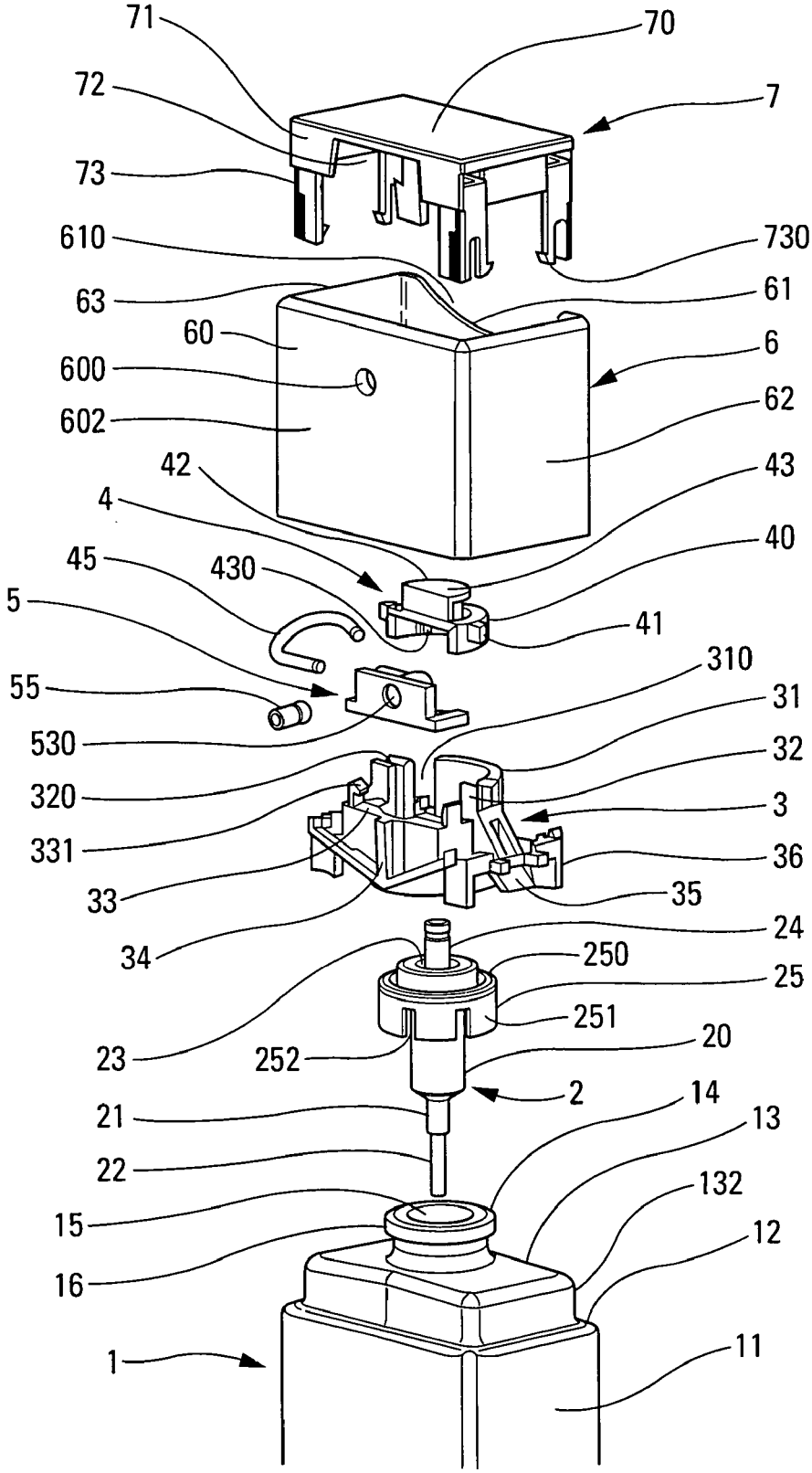
FIG. 1 is an exploded perspective view of a dispenser including a dispenser head of the invention for mounting on a reservoir.
Figure 2:
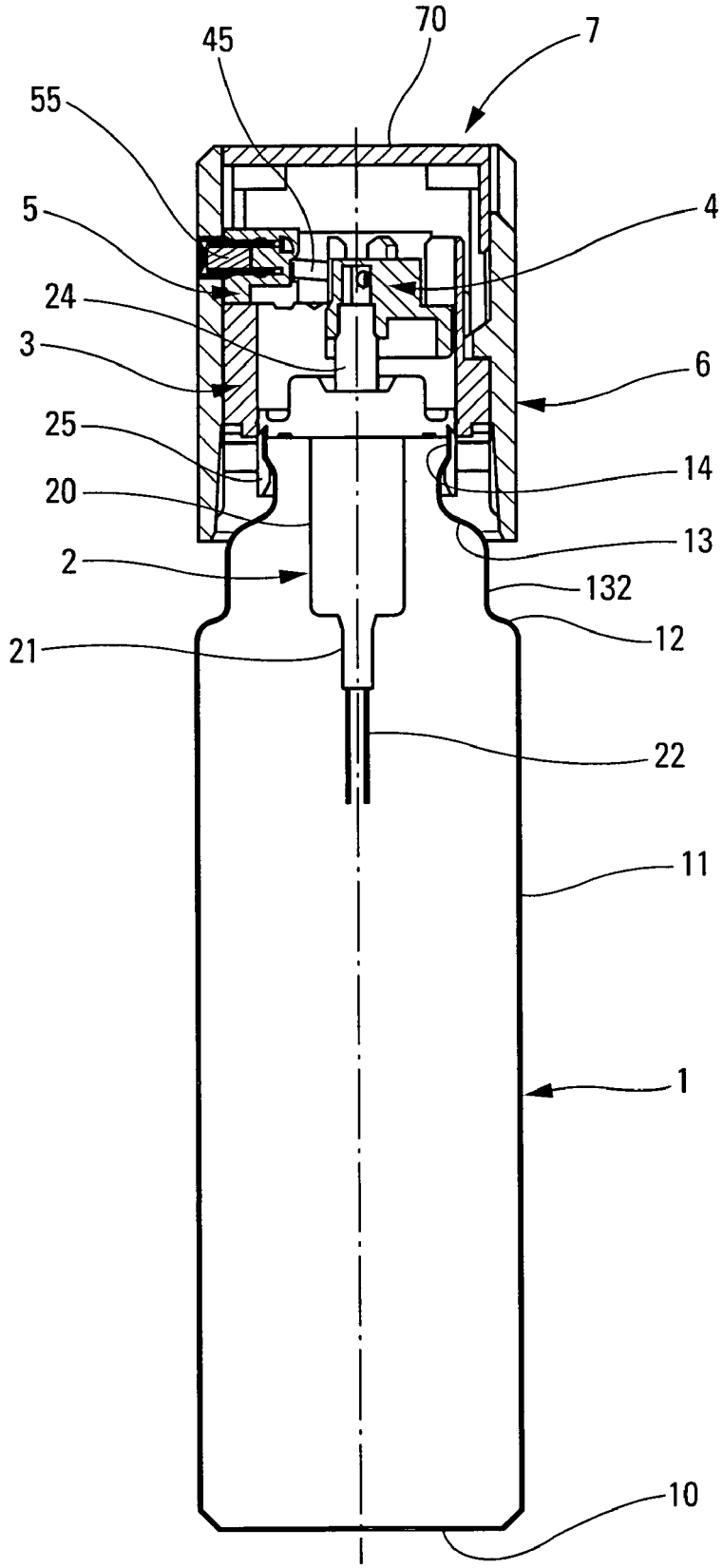
FIG. 2 is a longitudinal section view through the dispenser after the FIG. 1 dispenser head has been assembled, the dispenser head being in its final assembled position.

With reference to FIGS. 1 and 2, the dispenser head constituting an embodiment of the invention comprises a dispenser member 2, an insert 3, an endpiece 4, a nozzle-carrier 5, a covering jacket 6, and a pushbutton 7. The dispenser head is mounted on a reservoir 1, thereby together forming a fluid dispenser.

The reservoir 1 is for containing fluid. It can present any appropriate shape: rectangular, cylindrical, cubic, spherical, etc. The reservoir comprises a body 11, a bottom wall 10, a shoulder 12, a platform 13, and a neck 14.

The body 11 comprises a bottom end closed by the bottom wall 10, and a top end where the shoulder 12 extends. The shoulder 12 is below the platform 13. The shoulder is connected to the platform by means of a vertical wall 132. The platform 13 has an upwardly-projecting reservoir neck 14 passing therethrough. The neck 14 defines an opening 15 putting the outside environment into communication with the inside of the reservoir. The neck 14 advantageously includes an outwardly-projecting peripheral connection rim 16.

The dispenser member 2 can be a conventional pump or valve. Taking the example of a pump, the dispenser member 2 comprises a pump body 20 housing a pump chamber. The pump chamber can be provided with fluid inlet and outlet valves. The pump body 20 has a bottom portion and a top portion. The bottom portion includes a connection sleeve 21 that is suitable for receiving a dip-tube 22 so as to enable the fluid to be taken from the reservoir 1. The top portion includes a cavity 23 through which an actuator rod 24 is inserted. The actuator rod 24 is generally secured to a piston, and it defines an inside channel (not shown) through which fluid can pass. The rod is axially displaceable as a result of axial pressure being exerted. The displacement of the rod thus enables the piston to slide in sealed manner in the pump body 20 thereby varying the volume of the pump chamber. The piston and the rod are returned into their rest position under the action of a spring disposed in the pump body 20. The particular type of pump or valve is not critical for the present invention.

The dispenser member 2 is fastened onto the neck 14 of the reservoir 1 by means of a fastener ring 25. The fastener ring 25 can be a ring for crimping on, screwing on, or, as shown, snapping on.

In the present embodiment, the ring comprises a cap 250 from which connection tabs 251 extend vertically downwards. The tabs 251 are separated by spaces 252 and they are provided with inwardly-projecting catches. The cap 250 is for resting on the neck of the reservoir. The catches of the tabs 251 are suitable for being received beneath the rim 16 of the neck, so as to hold the dispenser member securely engaged in the opening of said neck. The spaces 252 mainly serve to impart flexible properties to the tabs 251, so as to make it easier to position the catches beneath the rim of the neck while the ring 25 is being fitted on the neck 14.

As shown in FIG. 1, and as shown in greater detail in FIG. 6, the insert 3 is a part of complex shape comprising a seat 30, a cylindrical part 31, guide rails 32, a slide cage 33, arrow-shaped return means 34, a sloping wall 35, and columns 36.

The seat 30 can present any appropriate shape: In the embodiment shown, the seat is of rectangular shape and therefore includes two short sides and two long sides. The seat is a sort of platform from which the other parts of the insert extend upwards, downwards, or over the periphery.

The cylindrical part 31 passes through the seat 30 so as to form a hollow duct 310. The shape and the dimensions of the duct 310 can therefore advantageously be defined by the cylindrical part 31 which presents a generally circularly-cylindrical shape in the embodiment shown.

The guide rails 32 can be formed over at least a fraction of the height of the cylindrical part 31 in the embodiment shown. By way of example, the guide rails can be two in number and can be located in diametrally opposite manner. The guide rails 32 comprise two facing vertical walls that are separated by a slide space 320.

The slide cage 33 extends outwards from the cylindrical part 31, substantially perpendicularly thereto. The cage 33 comprises a substantially plane slide surface 330 that is bordered by guide profiles 331. Each guide profile 331 comprises an upright provided with a guide barb. In the embodiment shown, there are two uprights disposed facing each other on either side of the slide surface 330. In the present embodiment, the guide barb presents a sloping face above a plane guide surface that is parallel to the slide surface 330.

In the embodiment shown, the columns 36 are disposed at the four corners of the rectangle forming the seat 30, and extend vertically on either side of the seat 30. By way of example, the columns 36 can present an L-shaped angle bard configuration.

The sloping wall 35 extends diagonally outwards from each short side of the seat 30.

The arrow-shaped return means 34 are advantageously two in number and are disposed on the long sides of the seat 30. Each of them comprises a vertical portion 340 and two flexible arms 341; Each of the flexible arms 341 is terminated by a bearing end 3410.

The vertical portion 340 extends from the seat 30 or from the cylindrical part 31.

The flexible arms 341 are disposed on either side of the vertical portion 340, and are angularly displaceable under the effect of pressure exerted on their respective bearing ends 3410.

When the insert 3 is assembled, the fastener ring 25 is engaged in the hollow duct 310 and becomes engaged with the inside of the cylindrical part 31, thereby locking the tabs of the ring around the neck of the reservoir. This engagement thus enables the insert 3 to be secured on the ring 25 in stable manner.

The endpiece 4 comprises a base 40 surmounted by a cover 42. The base 40 presents a generally circularly-cylindrical shape 1 that is truncated. Vertical splines 41, optionally provided with outwardly-projecting feet 410, can extend in diametrally opposite manner from the base 40. The cover 42 includes a bearing plate 43. A connection sleeve 430 extends vertically inside the endpiece 4 from the plate 43. An upstream connection sleeve 44 extends horizontally, perpendicularly to the connection sleeve 430. The inside of the upstream connection sleeve 44 and the inside of the connection sleeve 430 are in direct communication with each other.

The endpiece 4 is mounted on the dispenser member 2 by engaging the actuator rod 24 in the connection sleeve 430. Thus, the connection sleeve 430 defines an actuation axis, and the upstream connection sleeve defines an upstream axis that is perpendicular, or at least transversal, to the actuation axis. In order to engage the actuator rod in the connection sleeve 430 of the endpiece 4, the base 40 of the endpiece 4 is positioned within the cylindrical part 31. In order to start axial descent of the endpiece 4, the splines 41, optionally provided with feet 410, must slide in the slide spaces 320. Thereafter, axial pressure exerted on the bearing plate 43 enables the connection sleeve 430 of the endpiece 4 to be connected securely to the actuator rod 24. Thus, the channel defined inside the actuator rod is in connection with the inside of the connection sleeve 430.

The nozzle-carrier 5 is a support part for receiving the nozzle. The nozzle-carrier includes a vertical front wall 50 extending substantially perpendicularly in front of a shoe 52. The shoe 52 has lateral ends 51 that project beyond either side of the vertical front wall 60. A reception sleeve 53 extends horizontally from the rear of the front wall 50. The sleeve 53 opens out to an access 530 formed in the front wall 50. A downstream connection sleeve 54 advantageously extends perpendicularly to the reception sleeve 53. The inside of the sleeve 54 communicates with the inside of the sleeve 53.

A nozzle 55 is inserted into the reception sleeve 53 via an access 530. The nozzle thus completely closes the sleeve 53 and advantageously projects a little from the front wall 50. The nozzle has a dispenser channel passing therethrough, and includes a front surface 550 in which a dispenser orifice 5500 opens out. The dispenser channel thus communicates with the inside of the sleeve 54 so as to enable fluid to pass. The dispenser channel thus defines a dispenser axis. The dispenser axis is thus perpendicular, or at least transversal, to a downstream axis defined by the downstream connection sleeve 54.

The term "nozzle" should be considered in its widest sense, i.e. as a part, or as an element of a part, defining a dispenser orifice through which a flexible connection hose 45 interconnects the upstream and downstream connection sleeves 44 and 54. To do this, the hose 45 is engaged inside each of the connection sleeves 44 and 54, as shown in FIGS. 5*a* and 5*b*. It should be noted that the hose 45 can be changed from a linear configuration, shown in FIGS. 5*a* and 5*b*, to a U-shaped or a horseshoe-shaped configuration, shown in FIG. 6. The hose is put into a U-shape or a horseshoe shape while the endpiece 4 and the nozzle-carrier 5 are being mounted on the insert 3. This configuration advantageously has a hose 45 that is long enough to allow the endpiece 4 to move axially even though said endpiece is close to the nozzle.

Once the endpiece 4, the hose 45, the nozzle-carrier 5, and the nozzle 5 are assembled together, the assembly is mounted on the insert as shown in FIGS. 1 and 6. To do this, the endpiece 4 is mounted on the dispenser member 2 by engaging the actuator rod 24 in the connection sleeve 430. This engagement is achieved by placing the base 40 within the cylindrical part 31 and by positioning the splines 41, optionally provided with feet 410, in the slide spaces 320. Axial pressure is then exerted so as to connect the connection sleeve 430 securely to the actuator rod 24. Then, the nozzle-carrier 5 is placed on the slide surface 330 of the slide cage 33. The shoe 52 is thus displaced by sliding over said surface 330, being guided in translation and blocked against axial displacement by the projecting ends 51 becoming positioned under the plane guide surfaces of the guide profiles 331 of the insert.

The covering jacket 6 can be made out of a plastics material or out of metal. The jacket can present any appropriate shape, e.g. a rectangular block shape that is open at two opposite ends as shown in FIG. 1. In the present embodiment, the jacket 6 thus presents four walls: a front wall 60, two side walls 62, 63, and a rear wall 61. Each of the walls has an outside surface and an inside surface. The front wall 60 includes a housing 600 connecting its inside surface to its outside surface. In other words, the housing passes through the front wall 60. The rear wall 61 has a recessed portion 610 of circularly arcuate outline. It should be noted that the inside surfaces of the jacket 6 can form, or can be provided with, retainer catches (not shown). The catches can thus define a reception space for the insert 3.

Figure 3:
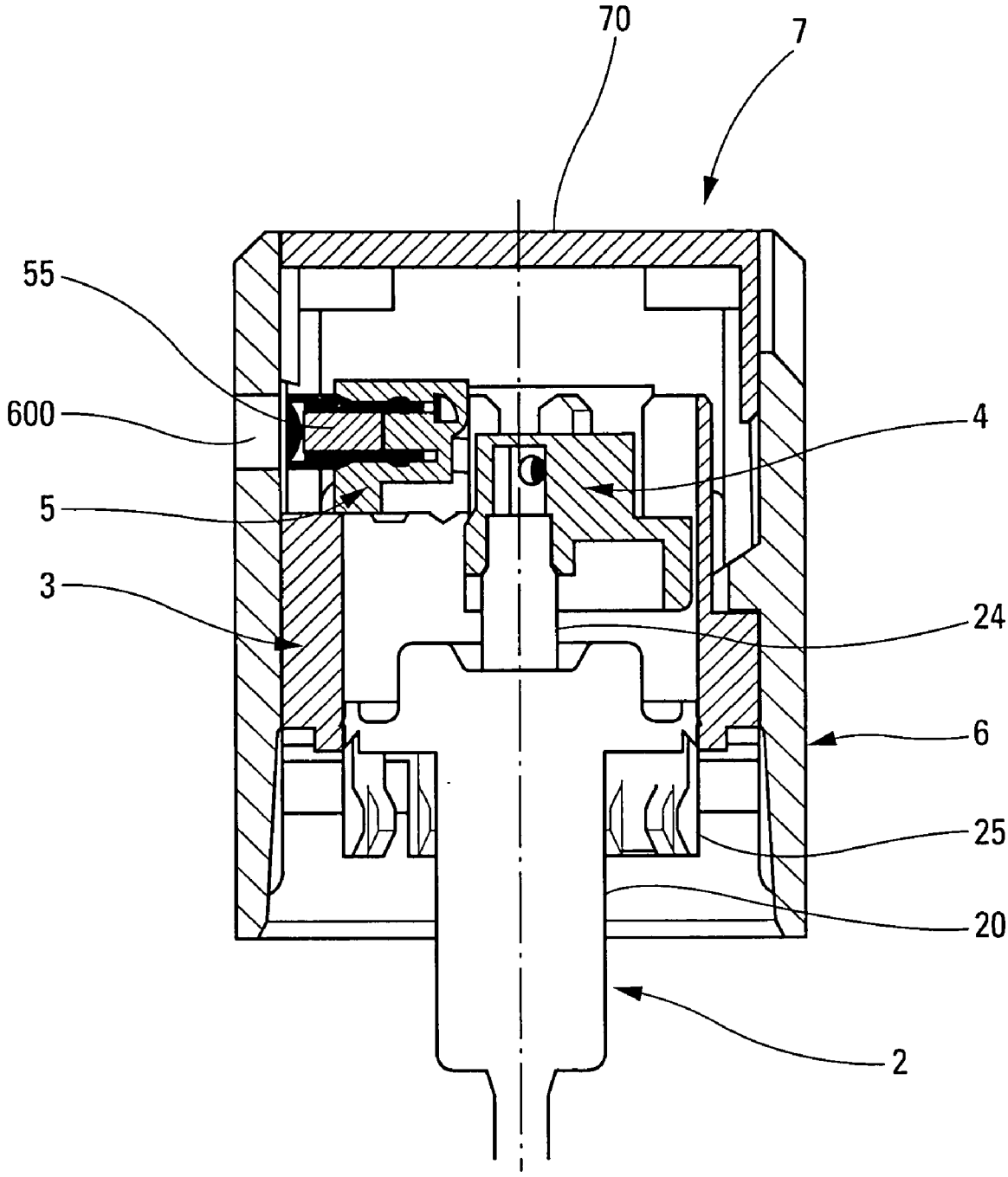
FIG. 3 is a perspective view of a dispenser head of the invention in its initial pre-assembly position.
Figure 4:
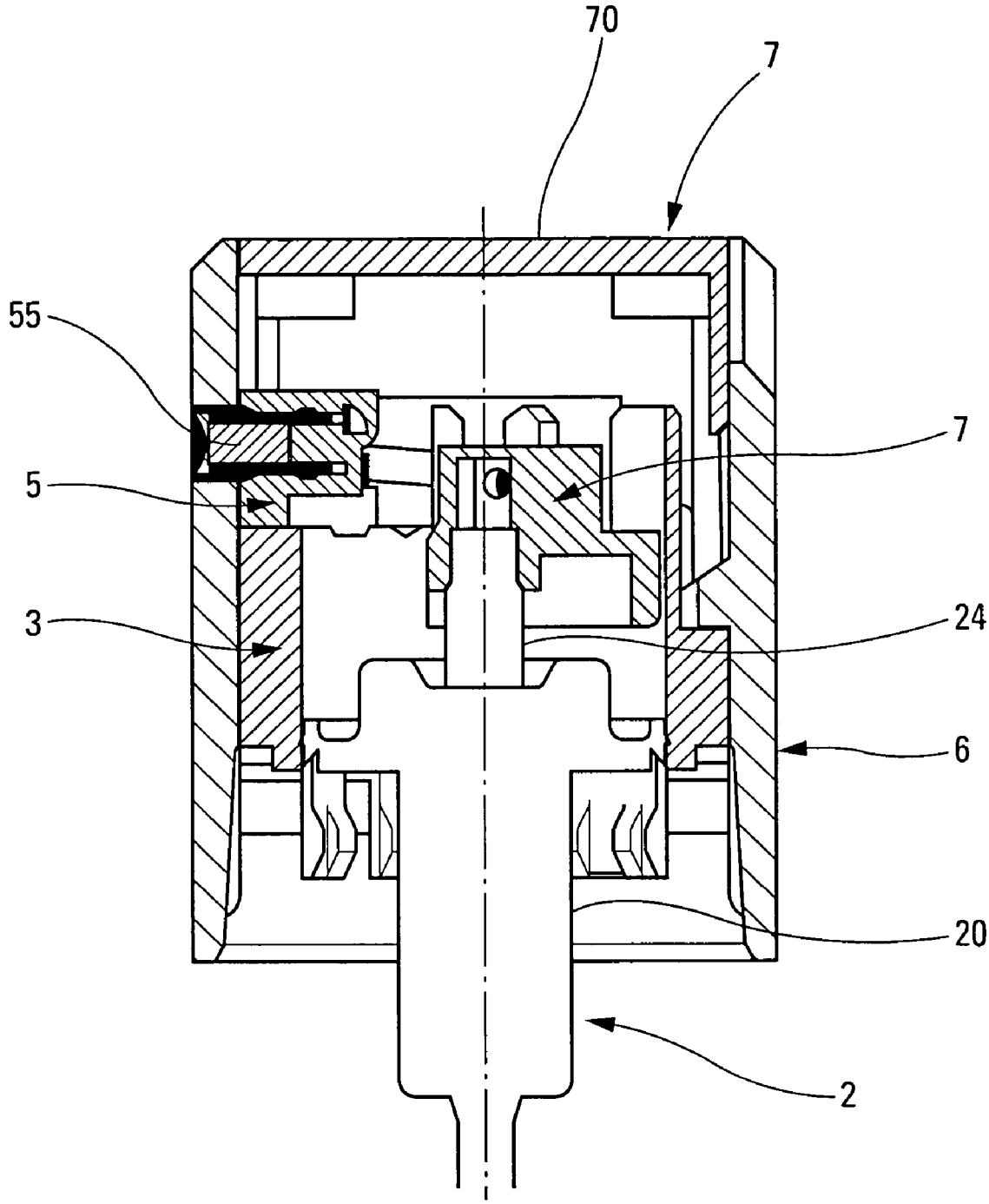
FIG. 4 is a perspective view of a dispenser head of the invention in its final assembled position.

The insert 3 on which the various above-described elements of the dispenser head are assembled, is mounted inside the jacket 6. Mounting can be performed by force fitting the insert in the jacket, or by merely snap-fastening the insert therein by moving it axially as far as the above-defined reception space. Under such circumstances, the insert can slide over the slopes of the retainer catches, and can then be blocked against moving in the opposite direction by the retainer catches once it has passed them. The insert is thus snap-fastened inside the jacket. When the insert 3 is finally positioned, the nozzle is placed facing the housing 600. The nozzle is advantageously displaceable between an initial pre-assembly position in which the nozzle is positioned inside the jacket, facing the housing, without being engaged in said housing, as shown in FIG. 3, and a final assembled position in which the nozzle is engaged in said housing, as shown in FIG. 4. The nozzle, mounted on the nozzle-carrier, is displaceable in radial translation, but is blocked against axial displacement. To achieve this translation, the nozzle-carrier slides in the slide cage 33 of the insert over a short distance between the initial pre-assembly position and the final assembled position. The nozzle is thus inserted into the housing 600 from the inside of the jacket. It should also be observed that the nozzle is firstly mounted on its support or nozzle-carrier, and only subsequently is the nozzle inserted into the housing in the jacket. It is thus not necessary to allow for fastener means for fastening the nozzle onto the nozzle-carrier in the housing of the jacket. The housing advantageously presents a shape and dimensions that are equal to the shape and dimensions of the nozzle, or dimensions that are slightly greater than the dimensions of the nozzle, so as to enable the nozzle to be received in the housing substantially without clearance. The housing and the nozzle are advantageously identical in shape, e.g. being circular, square, rectangular, oblong, etc.

The jacket 6 is for mounting on the reservoir 1. The bottom end of the jacket 6 thus becomes engaged against the vertical wall 132 of the reservoir, and can come to rest on the shoulder 12. The shape and dimensions of the jacket 6 and of the body 11 of the reservoir can be equivalent, so that the walls of the jacket 6 and the body 11 together form an even and continuous surface.

The pushbutton 7 comprises an actuation surface 70, a peripheral wall 71, and assembly tabs 73.

The actuation surface 70 can be a substantially plane, rectangular surface on which the user can press one or more fingers.

The peripheral wall 71 extends perpendicularly to the actuation surface 70 at the edges of said surface. The peripheral wall includes a front portion provided with a recess 72.

The assembly tabs 73 present an angle section, i.e. an L-shaped section. They can be four in number. The tabs 73 extend downwards from the corners of the peripheral wall 71, and include bottom ends provided with one or more snap-fastener profiles 730.

The pushbutton 7 is mounted in the jacket 6. In the embodiment shown, it is positioned between the inside surfaces of the jacket and the columns 36 of the insert. The tabs 73 of the pushbutton are thus guided axially between said inside surfaces of the jacket and said columns of the insert. The tabs 73 thus come into contact with the bearing ends 3410 of the return means 34. Finally, the snap-fastener profiles 730 become engaged beneath the retainer catches and thus prevent any possibility of the pushbutton being removed from the jacket. Consequently, the pushbutton, blocked in position by the retainer catches and urged against them by the return means 34, defines a rest position.

In order to dispense a quantity of fluid contained in the reservoir 1, the user presses on the actuation surface 70. It should be noted that in the present embodiment, the recess 72 serves to ensure that the vertical front wall 50 does not prevent the pushbutton 7 from being pushed down. In addition, pressing on the pushbutton is made easier by the presence of the recessed portion 610 formed in the jacket, said recessed portion enabling the user to extend a finger horizontally towards the rear so as to actuate the actuation surface 70. The actuation surface 70 thus becomes engaged with the bearing platform 43 of the endpiece 4, and thus causes the endpiece 4 and the actuator rod 24 to be displaced axially. This axial displacement thus causes fluid to rise from the pump chamber through the inner channel defined by the actuator rod 24. The fluid thus passes through the connection sleeve 430, the upstream connection sleeve 44, the connection hose 45, the downstream connection sleeve 54, and then through the dispenser channel of the nozzle 55, before finally flowing through the dispenser orifice 5500 of the nozzle. At the end of actuation, the return means 34 and the inner spring of the pump urge the pushbutton upwards. The return into the rest position therefore results from the bottom ends of the tabs 73 co-operating with the arrow-shaped return means 34, and from the piston, secured to the rod 24, being returned by the spring engaged in the pump body 20.

The present invention therefore guarantees that a housing 600 of the jacket 6 can present an opening that completely matches the shape and the dimensions of the nozzle 55. Thus, assembling the nozzle from the inside of the jacket results undeniably in a pleasing appearance.

Although the present invention is described above with reference to a particular embodiment thereof, naturally it is not limited by that embodiment. On the contrary, any useful modifications could be applied thereto by a person skilled in the art, without going beyond the ambit of the present invention as defined by the accompanying claims.

The invention claimed is:

1. A fluid dispenser head for mounting on a fluid reservoir (1), said head comprising:

a dispenser member (2) for taking fluid from the reservoir (1), said member (2) including a body (20) and an actuator rod (24) that is displaceable along an actuation axis;

an axially-displaceable pushbutton (7) for actuating the dispenser member (2) by pressing on the actuator rod (24);

a covering jacket (6) for mounting securely relative to the reservoir (1), the pushbutton (7) being axially movable relative to the jacket (6), said jacket (6) having a stationary reception housing (600) formed therein; and a nozzle (55) through which the fluid is dispensed each time the dispenser member (1) is actuated, the nozzle (55) being received in said stationary reception housing (600) of the jacket (6), so that the nozzle (55) is held axially relative to the reservoir (1), the nozzle (55) being received in said housing (600) from inside the jacket (6);

in which the nozzle (55) is configured to be guided in translation between an initial pre-assembly position in which the nozzle (55) is positioned inside the jacket (6), facing the housing (600), without being engaged in said housing (600), and a final assembled position in which the nozzle (55) is engaged in said housing (600); and in which the nozzle is configured to be guided in translation between the initial pre-assembly position and the final assembled position with the jacket already securely mounted relative to the reservoir.

2. A dispenser head according to claim 1, in which the nozzle (55) is received in the housing (600) substantially without clearance.

3. A dispenser head according to claim 1, in which the housing (600) is sized equal to, or slightly greater than, the nozzle (55).

4. A dispenser head according to claim 1, in which the nozzle (55) is secured to a nozzle-carrier (5).

5. A dispenser head according to claim 4, in which the nozzle-carrier (5) is guided to move in translation and blocked against axial displacement on an insert (3) that is securely mounted relative to the jacket (6).

6. A dispenser head according to claim 5, in which the nozzle-carrier (5) includes a shoe (52), and the insert (3) includes a slide cage (33), and the shoe (52) is received in the cage (33) in such a manner as to be displaceable in translation.

7. A dispenser head according to claim 4, further comprising an endpiece (4) mounted on the actuator rod (24) so that the endpiece (4) is axially displaceable with the rod (24), the nozzle-carrier (5) being connected to the endpiece (4) by a flexible connection hose (45).

8. A dispenser head according to claim 1, further comprising: an endpiece (4) mounted on the actuator rod (24) so that the endpiece (4) is axially displaceable with the rod (24), said endpiece (4) including an upstream connection sleeve (44) defining an upstream axis; the nozzle (55) defining a dispenser axis, the nozzle (55) being secured to a downstream connection sleeve (54) defining a downstream axis; and a flexible connection hose (45) connecting the upstream sleeve (44) to the downstream sleeve (54), the downstream axis being transversal to the dispenser axis.

9. A dispenser head according to claim 8, in which the upstream axis is transversal to the actuation axis.

10. A dispenser head according to claim 8, in which the flexible hose (45) extends with a U-shaped or horseshoe-shaped configuration.

11. A dispenser head according to claim 1, in which the housing (600) and the nozzle (55) present identical shapes that are advantageously circular.

12. A dispenser head according to claim 1, in which the jacket (6) presents an outside surface and an inside surface, the housing (600) connecting the inside surface to the outside surface, the nozzle (55) including a front surface (550) that is provided with a dispenser orifice (5500), said front surface being situated substantially in the same plane as the outside surface of the jacket.

13. The dispenser head according to claim 1, in which a diameter of the housing (600) is equal to or greater than a diameter of the nozzle (55).

14. The dispenser head according to claim 1, wherein the dispenser member is a pump.

15. The dispenser head according to claim 1, wherein the translation in which the nozzle is configured to be guided is in a generally radial direction of the dispenser.

* * * * *